United States Patent [19]

Quong

[11] Patent Number: 4,529,088

[45] Date of Patent: Jul. 16, 1985

[54] SHIPPING-AND-STORAGE CONTAINER FOR PRODUCE

[76] Inventor: Paul Quong, 1914 Orangewood Ave., Ste. 102, Orange, Calif. 92668

[21] Appl. No.: 623,498

[22] Filed: Jun. 22, 1984

[51] Int. Cl.[3] ..... B65D 21/02; B65D 25/04; B65D 1/36

[52] U.S. Cl. ..... 206/509; 206/512; 220/21; 220/23.6; 220/23.8; 229/DIG. 11

[58] Field of Search ..... 206/509, 512; 220/21, 220/22, 23.6, 23.8; 229/DIG. 11

[56] References Cited

U.S. PATENT DOCUMENTS

| | | | |
|---|---|---|---|
| 3,203,573 | 8/1965 | Rowe | 220/23.6 |
| 3,448,914 | 6/1969 | Scholz | 206/512 |
| 3,463,378 | 8/1969 | Van Daalen | 206/512 |
| 3,502,241 | 3/1970 | Smith | 220/23.8 |
| 3,667,647 | 6/1972 | Van Daalen | 206/509 |
| 4,432,456 | 2/1984 | Ovadia | 206/509 |

FOREIGN PATENT DOCUMENTS

| | | | |
|---|---|---|---|
| 851371 | 1/1940 | France | 229/DIG. 11 |
| 2292631 | 6/1976 | France | 229/DIG. 11 |
| 1146029 | 3/1969 | United Kingdom | 206/509 |

*Primary Examiner*—George F. Lowrance
*Attorney, Agent, or Firm*—Francis X. LoJacono

[57] ABSTRACT

This invention discloses an improved container designed for shipping and storing fresh produce, particularly strawberries. The container includes a substantially rectangular basket-support tray in which a plurality of receptacles are formed to receive baskets therein. A peripheral frame member is fixedly secured to the basket-support tray and is positioned thereon to further define an interlocking arrangement between superposed containers so as to stabilize a group of containers when vertically stacked.

10 Claims, 7 Drawing Figures

SHIPPING-AND-STORAGE CONTAINER FOR PRODUCE

BACKGROUND OF THE INVENTION

1. Field of the Invention

This invention relates generally to shipping and storage containers, more particularly for use with fruit and vegetable produce, especially strawberries.

2. Description of the Prior Art

There are various problems and difficulties being encountered in providing suitable means for shipping and storing berry produce.

Currently, the strawberry industry employs a corrugated paper, box-like tray that is so constructed as to include two compartments defined by a central partition. Each compartment is formed to receive a group of six baskets, for a total of twelve baskets. Such trays are used in large quantities and are thus generally supplied to the growers in collapsed form, so that an assembly machine must be employed to erect each tray in order to receive twelve plastic, web-like baskets, which are well known in the art. In fact, at the present time the above-described shipping-and-storage trays and plastic baskets are the only ones being employed in the strawberry industry.

When loaded with berry baskets, the known trays must be stacked on pallets which normally provide for sixteen layers of trays, arranged six to each layer, for a total of ninety-six per pallet. However, in order to stack the layers in such an arrangement, a pair of stacking wires must be inserted into each tray, one wire in each end wall, so as to link the tray with the superposed tray. This stacking arrangement has not been found to be completely satisfactory for long periods of time during hauling. The stacked load must also be carefully handled so as to prevent tipping, which often occurs.

Due to the paper-type construction of these trays, they can not be exposed to a wet environment because their individual compressive strength will change, allowing the well structures of the trays to collapse and thereby crushing the berries stored therein.

Further, the arrangement of the trays and their baskets results in unsatisfactory grower yield per acre, since more berries are picked and stored in each tray of baskets than are needed. This situation causes additional handling at store level because each individual basket must be removed from its tray and repackaged to provide for the excess berries. Even though the store can fill two or three additional baskets, it is costly—since it is time-consuming and expensive to have high-salaried store clerks handle the unpacking and repacking of the berries.

As other examples of the various storage containers and systems for packaging, one may refer to the following United States patents.

U.S. Pat. No. 3,539,071 to R. E. Ludder discloses a packaging structure that includes a plurality of nestable containers such that individual containers are positioned and retained in a carrier tray. The actual carrier-container assemblies are placed in cartons and shipped to the respective dairies, etc., which fill the individual containers while they remain in the carrier trays; and the carrier trays are then repackaged in cartons or the like for shipment to the end user.

U.S. Pat. No. 3,651,976 to G. R. Chadbourne discloses a molded packaging tray comprising a plurality of interconnected elongated container sections. The trays are formed for stacking, one above the other, with alternate trays being oriented differently from adjacent ones.

U.S. Pat. No. 3,884,381 to G. Kaupert discloses a nestable compartmentalized tray made of thin sheet material and having a plurality of downwardly narrowing cup-shaped depressions. Trays of this structure may be nested in one another to form a tray stack.

Another nestable and stackable support tray is disclosed in U.S. Pat. No. 4,242,834 to R. C. Olsen. This tray is particularly designed as a planting system that includes a support tray, a plurality of interconnected sleeves, and a plurality of transplant frames adapted for insertion within each sleeve.

SUMMARY OF THE INVENTION

The present invention has for an important object a provision wherein various types of produce can be readily stored and transported in an open box-like container over long distances without damage to the container or the produce stored therein. The container of the present invention is formed with a lightweight frame structure which defines a basket-support tray having a plurality of contiguously formed openings or receptacles adapted to receive a plurality of lightweight plastic baskets. Mounted about the tray structure is a peripheral frame member, preferably a sheet of corrugated material. The peripheral frame member establishes side wall members for the container, but more importantly provides a means for stackably interlocking superposed containers during storage and/or shipping.

Another object of the present invention is to provide a shipping-and-storage-container unit for fresh produce wherein a multiplicity of containers are stackable in an interlocking arrangement to allow safe shipping or transporting by pallets, without the need for additional interlocking devices such as wires or tie sheets as are now employed.

A further object of the invention is to provide a shipping-and-storage container of this character that allows additional containers to be loaded on trucks for long-range transportation, due to the unique high-compressive and flexual strength level of each loaded container, the compressive-strength performance being unchanged, regardless of ambient temperatures and/or mositure exposure. The tray of the container is designed as a monolithic structure formed from expanded polystyrene material that provides a key high-strength level, and thus does not depend upon quality of glued joints as in existing containers used in the strawberry industry.

A still further object of the present invention is to provide a container of this character that allows a predictable quantity of fruit to be packed in each basket, which then allows an increased per-acre yield for the grower.

Still another object of the invention is to provide a device of this character that is relatively inexpensive to manufacture, and that is simple yet rugged in construction.

BRIEF DESCRIPTION OF THE DRAWINGS

Novel features and advantages of the present invention in addition to those mentioned above will become apparent to those skilled in the art from a reading of the following detailed description in conjunction with the accompanying drawings, wherein.

DESCRIPTION OF THE PREFERRED EMBODIMENT

Figure 1:
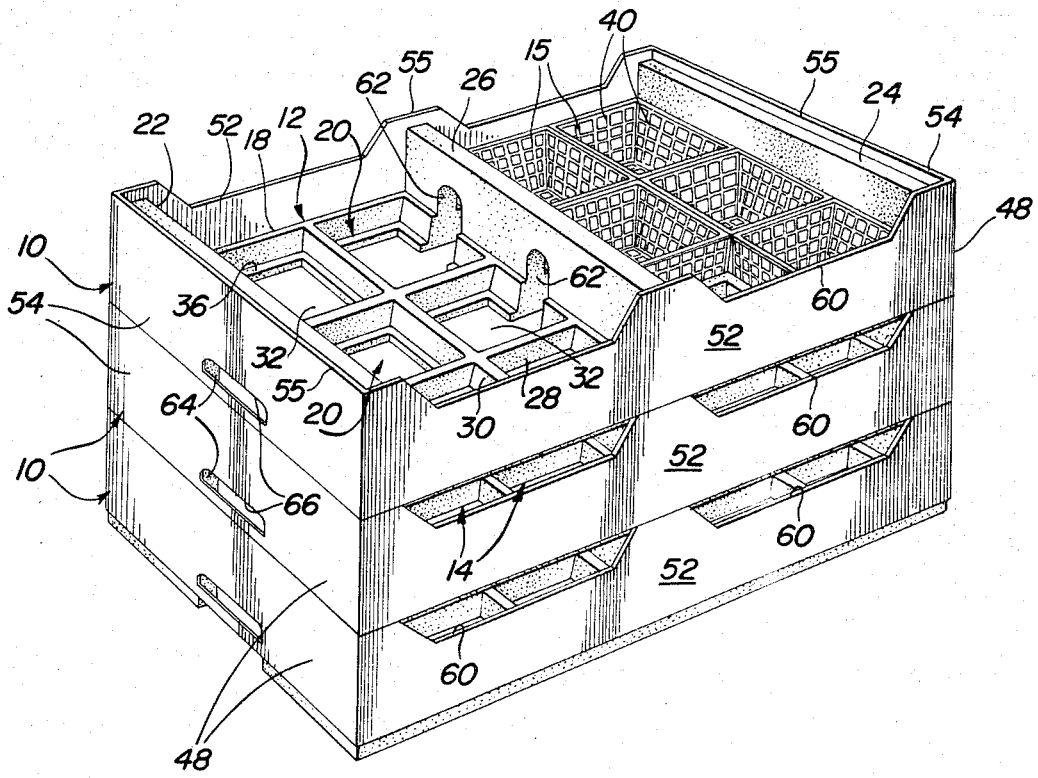
FIG. 1 is a perspective view of a multiplicity of stacked shipping-and-storage-container units, having individual baskets shown supported in the tray structure.

Referring more particularly to FIG. 1, there is shown a plurality of stacked shipping-and-storage containers, generally indicated at 10. Accordingly, the present invention defines a produce shipping-and-storage container 10 which will hereinafter be referred to as a "container unit", this unit being especially adapted to store and ship small fruits and vegetables, such as strawberries, cherry tomatoes, etc.

As illustrated in FIG. 1, the exterior walls of each container unit 10 are formed to provide a contiguous, unobtrusive, exterior structure which allows not only vertical stacking but also side-by-side packing on pallets in a more secure interlocking manner than is possible with the presently used shipping containers. Thus, each container unit 10 comprises a basket-support tray, generally designated at 12, having a plurality of pocket-like openings which define receptacles 14 formed in a contiguous manner to receive and support individual baskets 15.

Figure 2:
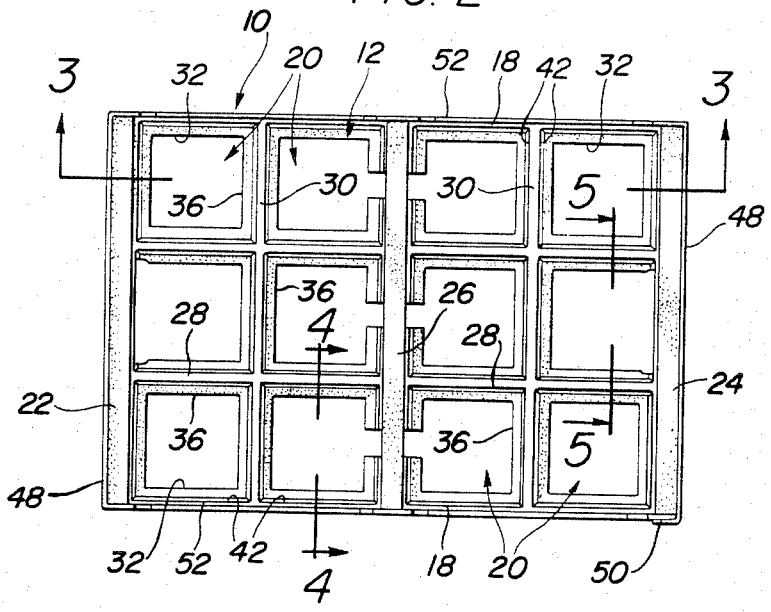
FIG. 2 is a top-plan view of the present invention, showing some of the baskets removed from the receptacles.

Basket-support tray 12 establishes the basic structure of the present invention and is preferably formed from expandable polystyrene material. The tray is structured in a substantially rectangular configuration defined by peripheral side walls 18, end walls 22 and 24, and a centrally disposed truss or partition wall 26 which is interposed midway between end walls 22 and 24, as illustrated in FIGS. 2 and 3.

Accordingly, there are provided a plurality of receptacles 14 which are formed in groups of six. That is, a first basket-support section of six receptacles is arranged between end wall 22 and partition wall 26, a second basket-support section of six receptacles being arranged between partition wall 26 and end wall 24, as illustrated in FIG. 2. Each receptacle 14 is defined by the longitudinal side walls 18, end walls 22 and 24, and partition wall 26, and further includes inner longitudinal wall members 28 together with transverse wall members 30. All of the above wall members are integrally formed so as to establish the individual receptacles, which in themselves form openings 32 to allow air to pass freely through baskets 15 supported in receptacles 14. The ability of the present invention to allow constant air flow through the containers and stored produce is very important, and will be further described herein.

Each receptacle is also formed having an inner, peripheral, flange member 36 on which a basket 15 is supported. The inner surface of the integral wall member of each receptacle has an inclined configuration to match the inclined wall 40 of a basket 15. The four contiguous tapered or inclined surfaces 42 of each receptacle 14 provides a secure fit between baskets 15 and tray 12.

Figure 3:
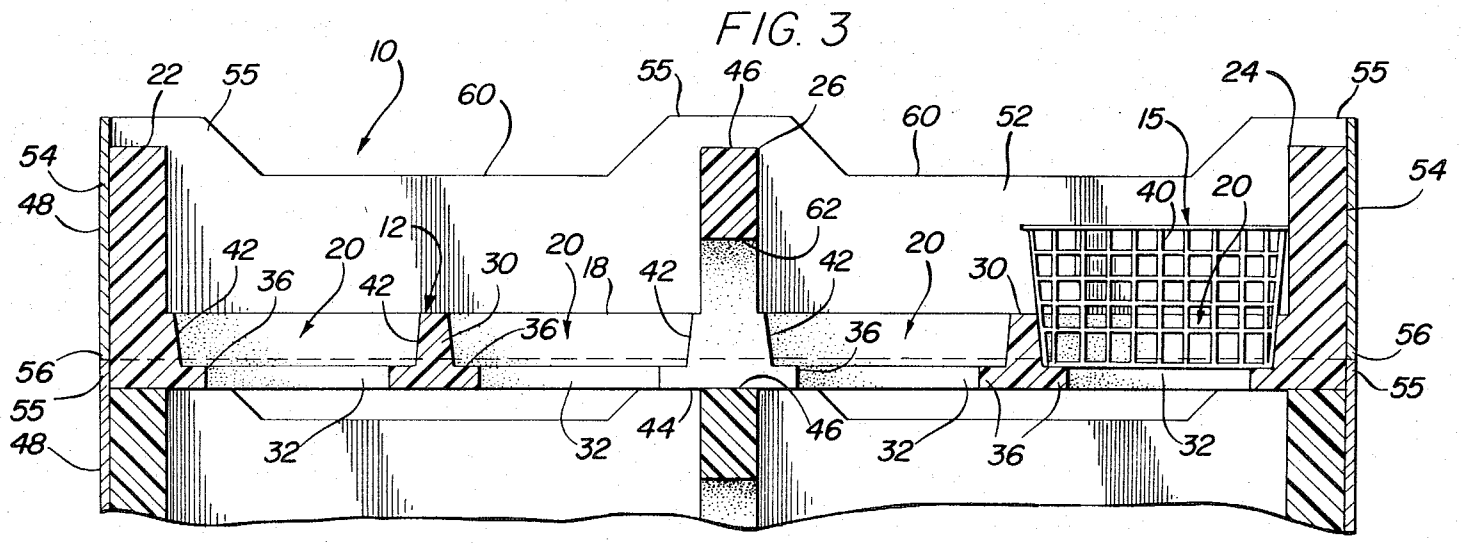
FIG. 3 is an enlarged cross-sectional view taken along line 3—3 of FIG. 2.
Figure 4:
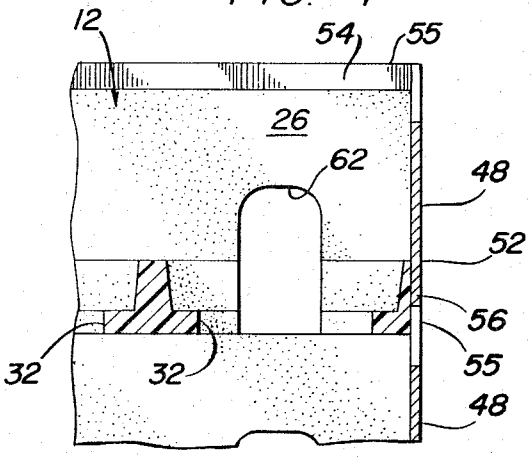
FIG. 4 is an enlarged cross-sectional view taken along line 4—4 of FIG. 2.
Figure 5:
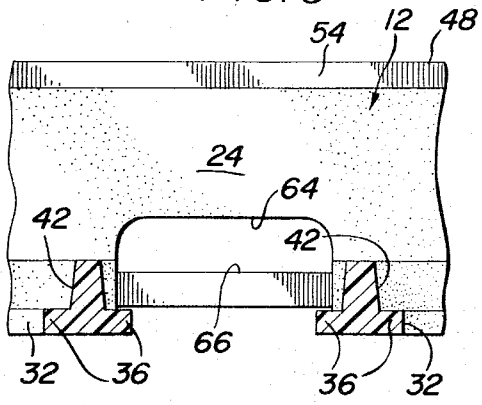
FIG. 5 is an enlarged cross-sectional view taken substantially along line 5—5 of FIG. 2.

As can be seen in FIG. 3, the bottom surface or wall structure 44 is substantially flat throughout so as to allow the container units 10 to be stackably mounted in a vertical superposed arrangement, one above the other, in a very stable manner. The upper surfaces 46 of wall members 22, 24 and 26 provide a corresponding flat support means for mating engagement with the bottom surfaces 44 of the containers mounted thereupon. However, to establish an interlocking means between each stacked container unit 10, there is provided an outer peripheral frame member 48. This frame member is preferably made from corrugated board that is positioned about the rectangular perimeter of tray 12 and secured at 50 to itself, and then bonded or glued to the outer peripheral surface of the tray so as to prevent frame member 48 from being removed therefrom.

It is important to note, however, that frame member 48 is formed and positioned to provide an interlocking means between the vertically stacked container units. That is, frame member 48 is formed having side walls 52 and end walls 54, wherein all or portions of the upper edges 55 thereof extend above end walls 22 and 24, and central partition 26 of tray 12, as shown in FIGS. 1 and 3. The lower or bottom edge 56 of frame member 48 is positioned above bottom surface 44 of tray 12. This arrangement allows the extended bottom of tray 12 to be inserted into the opening defined by the upper extended edges 55 of frame member 48, as shown in the cross-sectional view of FIG. 3.

As previously mentioned, air circulation is very important to the stored produce, and in order to accomplish a free air flow throughout all the containers, when stacked, each side wall 52 has a portion thereof notched out as at 60. Thus, air flows through notches 60, up through openings 32, and into and through baskets 15. Center partition 26 is also formed with cut-outs so as to provide air passages 62, the end walls 22 and 24 being provided with air passages 64. End walls 54 of frame member 48 include apertures 66 which align with passages 64. This alignment of passages 64 with apertures 66 further defines a handle means for carrying the container units.

Figure 6:
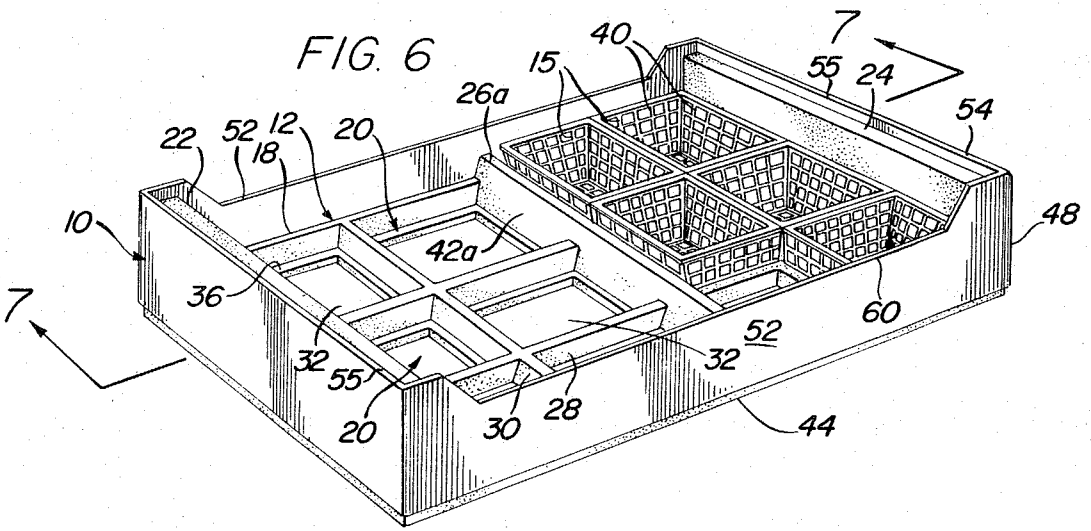
FIG. 6 is a perspective view of an alternative embodiment of the container unit.
Figure 7:
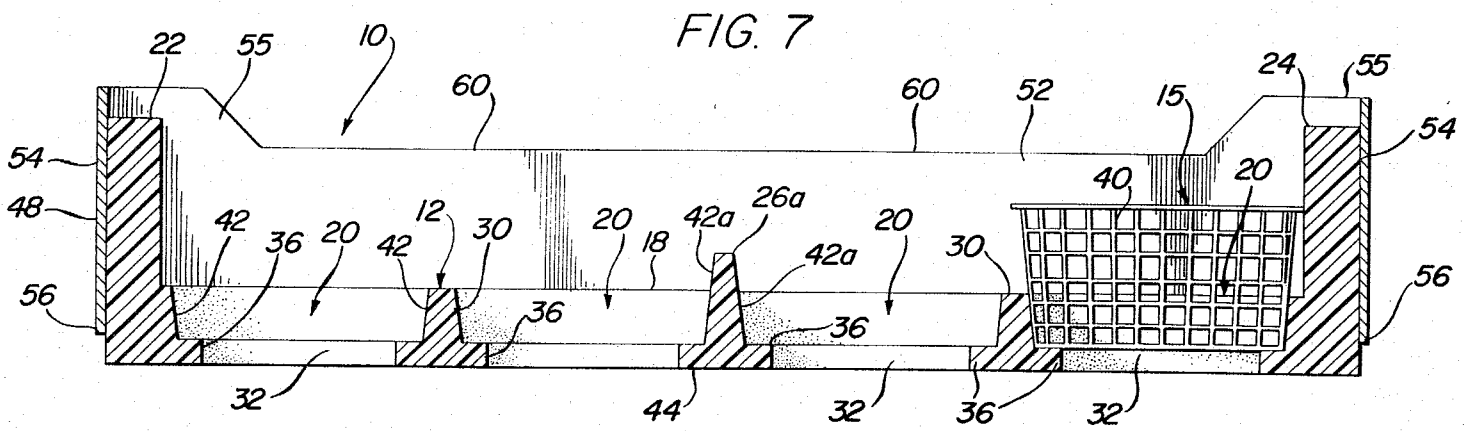
FIG. 7 is a longitudinal cross-sectional view taken substantially along line 7—7 of FIG. 6.

Referring now to FIGS. 6 and 7, there is shown an alternative arrangement of the present container unit 10 which is formed basically the same as the one hereinbefore described, with one exception—that being that the central truss or partition **26*a* does not extend upwardly so as to be equal in height to side walls 22 and 24 as in the first embodiment. However, this arrangement still provides a sufficient strength for truss 26*a*, whereby tray 12** is well supported throughout its length. That is, the central partition acts as a truss beam, thus preventing structural bending or fatigue when the tray is fully loaded with produce.

Truss **26*a* is formed with extended inclined walls 42*a* to receive baskets 15, and it includes flange members 36 for basket support. The structural arrangement of this embodiment allows for a shorter overall length of the container, so as to conform to various shipping conditions. Since the length of the span between side walls 22 and 24 is shorter, the central truss or partition 26*a*** is not required to act as an intermediate support for superpositioned stacked containers, even when fully loaded with produce.

It may be thus seen that the invention will be understood from the foregoing description; and it will be apparent that various changes may be made in the form, construction and arrangement of the parts of the invention without departing from the spirit and scope thereof or sacrificing its material advantages, the embodiments hereinbefore described being merely by way of example; and I do not wish to be restricted to the specific forms shown or uses mentioned, except as defined in the accompanying claims.

I claim:

1. A container adapted to support a plurality of baskets for shipping and storing fresh produce, wherein said container comprises:

a basket-support tray having a substantially rectangular configuration, including oppositely disposed, transverse, end walls and an intermediate truss centrally positioned between said transverse end walls, defining first and second basket-support sections;

a pair of outer longitudinal side wall members integrally formed with said end walls and said intermediate truss;

a plurality of integrally formed, longitudinally and transversely disposed, inner wall members;

a plurality of contiguous receptacles defined by said walls of said basket-support tray;

a peripheral frame member fixedly mounted to the peripheral wall members of said basket-support tray; and interlocking means formed between said peripheral frame member and said basket-support tray, whereby a multiplicity of containers are adapted to be vertically stacked to prevent separation thereof during shipping and storage.

2. A container as recited in claim 1, wherein each of said receptacles includes an inner, peripheral, flange member, providing a support means for said basket, and wherein said flange defines an opening in said receptacle.

3. A container as recited in claim 2, wherein said tray includes air-passage means to establish air flow throughout said tray when produce is stored therein.

4. A container as recited in claim 3, wherein said air-passage means includes said opening in said receptacle, and passages formed in said end walls.

5. A container as recited in claim 3, wherein said peripheral frame member comprises a plurality of wall members forming a rectangular configuration, and wherein said air-passage means includes notches formed in at least two opposing wall members.

6. A container as recited in claim 5, wherein said container includes handle means formed in said end walls of said tray.

7. A container as recited in claim 5, wherein said tray is formed having a substantially flat bottom wall, and wherein at least said end walls are formed having substantially upper flat surfaces so as to engage said flat bottom wall of a superposed tray.

8. A container as recited in claim 7, wherein said interlocking means is provided by the positioning of said frame member with respect to said tray.

9. A container as recited in claim 7, wherein said interlocking means is provided by fixedly positioning said frame member to said tray, the upper free edge of said frame member being located above said upper flat surfaces of said end walls and said intermediate truss of said tray, and wherein said flat bottom wall of said tray extends below said frame member.

10. A container as recited in claim 9, wherein said intermediate truss is equal in height to said end walls, so as to engage said flat bottom wall of said tray together with said end walls of said tray, whereby a central support is defined by said intermediate truss.

* * * * *